United States Patent [19]

Calmes et al.

[11] 4,196,942

[45] Apr. 8, 1980

[54] LEAD-IN GUIDEWAY FOR A ROLLING AND PUNCHING MACHINE

[75] Inventors: Jean P. Calmes, Lausanne, Switzerland; Edgardo Gnecchi, Sesto S. Giovanni, Italy

[73] Assignee: Innocenti Santeustacchio, Brescia, Italy

[21] Appl. No.: 888,241

[22] Filed: Mar. 20, 1978

[30] Foreign Application Priority Data

Apr. 21, 1977 [IT] Italy ..... 22695 A/77

[51] Int. Cl.[2] ..... F16C 31/06

[52] U.S. Cl. ..... 308/3 R

[58] Field of Search ..... 308/3 R, 3 A, 5 R, 6 R, 308/6 A, 4 C

[56] References Cited

U.S. PATENT DOCUMENTS

| | | | |
|---|---|---|---|
| 3,907,385 | 9/1975 | Bartenstein | 308/3 A X |
| 4,039,107 | 8/1977 | Boley | 308/3 A X |

*Primary Examiner*—Douglas C. Butler

*Attorney, Agent, or Firm*—Birch, Stewart, Kolasch & Birch

[57] ABSTRACT

The present invention is directed to a pressure and piercing mill for converting a square bar, coming from a bar rolling mill or directly from a continuous casting plant, into a round, axially pierced blank. The basic machine includes inlet and outlet guide members which are positioned adjacent to a pair of rolling cylinders having round grooves and a mandrel which extends along the rolling axis and from the outlet side of the guide members. In addition, a pushing member is provided for driving the square bar through the inlet and outlet guides, the rolling cylinders and against the piercing bit. The present invention is directed to an improved inlet and outlet guide members which ensure that the blank is accurately centered on the rolling and piercing axis during its travel through the pressure and piercing mill. This improved centering of the square bar is achieved by providing an inlet guide which includes a rectilinear tunnel having a square cross section and made of four linear groups extending parallel to the rolling axis and held independently of one another by a stationary frame. Each linear group comprises a longitudinal, rigid, internal, flat rectilinear wall. At least two consecutive linear groups are movable in a direction perpendicular to the rolling axis when a predetermined pressure is exerted on the flat rectilinear walls of the consecutive linear groups from within the rectilinear tunnel.

4 Claims, 6 Drawing Figures

LEAD-IN GUIDEWAY FOR A ROLLING AND PUNCHING MACHINE

The invention relates to an inlet guide for a pressure piercing mill.

A pressure and piercing mill, hereinafter denoted by the symbol PPM only, is a machine for converting a square bar, coming from a bar rolling mill or directly from a continuous casting plant, into a round, axially pierced blank. A machine of this kind basically comprises a controlled pair of rolling cylinders having round grooves, a mandrel which extends along the rolling axis and from the outlet side of the controlled pair, one end of the mandrel having a coaxial piercing bit, and a pushing member for driving a square bar for piercing through the rolling cylinders and against the piercing bit.

In order to ensure that the blank is accurately pierced along its axis the square bar must be accurately centred on the rolling and piercing axis during its travel through the PPM. To this end a PPM usually comprises an inlet guide and an outlet guide, both being suitably designed and dimensioned. At present, an inlet guide is designed either as a tubular rectilinear duct having a square cross-section or as a rectilinear tunnel, likewise having a square cross-section and defined by a number of rollers, which are motor-driven if required.

As is known, a square bar entering a PPM has a temperature of the order of 1250° C. It is also known that, as a result of the high temperature and the thrust exerted on it by the thrust member and pressing it against the PPM piercing bit, the bar undergoes deformation and progressive buckling, starting from its end in connection with the thrust member. The amount of buckling may be up to 4%.

As a result, in the case in which the inlet guide comprises a tubular duct having a square cross-section, the bar will not travel through the guide unless its transverse dimensions, right from the beginning, are increased by at least 4% of the rated bar cross-section. Furthermore, with reference as before to the rated bar cross-section, the inlet guide cross-section must be further increased to allow for positive tolerances in the size of the bar. This necessary increase in the inlet guide cross-section is such that centring cannot be guaranteed at the beginning of axial piercing of the bar, i.e. just at the time when it is most important to centre the bar along the rolling and piercing axis.

A roller guide inlet substantially reduces the aforementioned serious disadvantage, since it allows the use of passages having smaller cross-sections, since the guide rollers can exert a deforming action on the bar, thus reducing the clearance and improving the guidance of the bar. However, a roller inlet guide has a technical disadvantage in that rollers, owing to their shape, cannot hold and guide the bar in the immediate neighbourhood of the rolling cylinders and the PPM piercing bit.

The invention is based on the problem of providing a PPM inlet guide having structural and functional characteristics such as to obviate the disadvantages mentioned hereinbefore with reference to the prior-art inlet guide.

To this end, according to the invention, it comprises a rectilinear tunnel having a square cross-section and made up of four linear groups extending parallel to the rolling axis and held independently of one another by a stationary frame, each linear group comprising a longitudinal, rigid, internal, flat rectilinear wall, at least two of the linear groups being movable parallel to themselves against the action of pressure means borne by the frame, when a pressure above a given value is exerted on the walls from the interior of the tunnel.

According to another feature, the pressure means comprise corresponding hydraulic cylinders loaded with an operating fluid at a given pressure.

Further features and advantages of the invention will be clear from the following description of an embodiment of an inlet guide for a PPM rolling mill according to the invention, with reference to the following illustrative non-limitative drawings in which.

Figure 1:
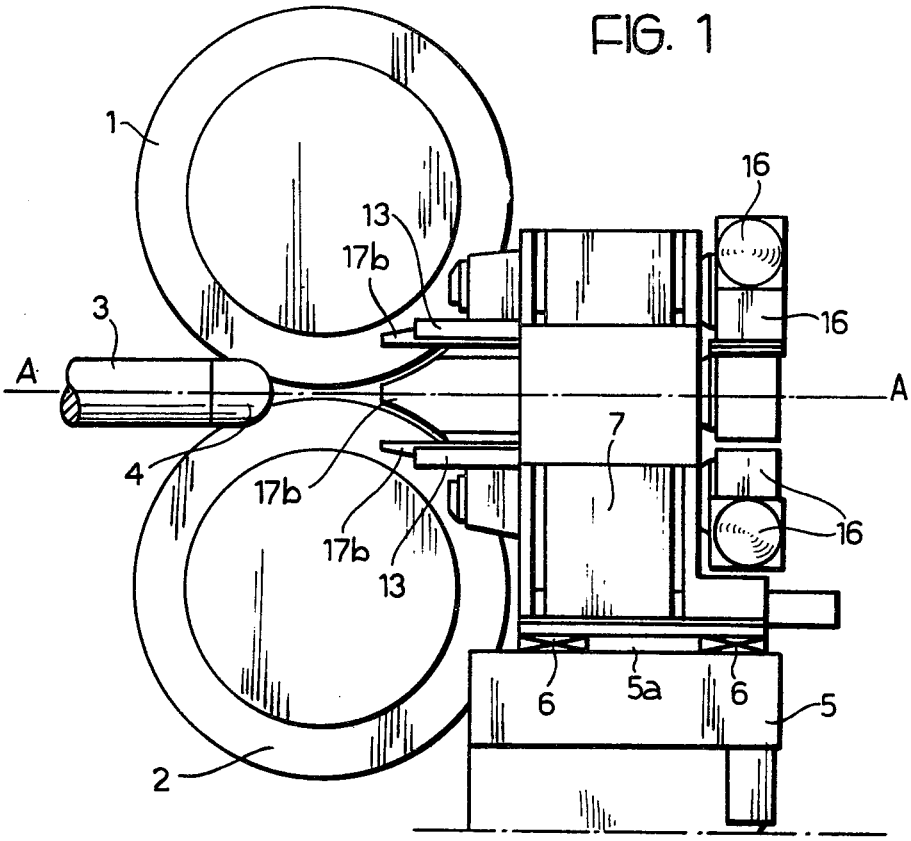
FIG. 1 is a side view of an inlet guide for a PPM rolling mill according to the invention.
Figure 2:
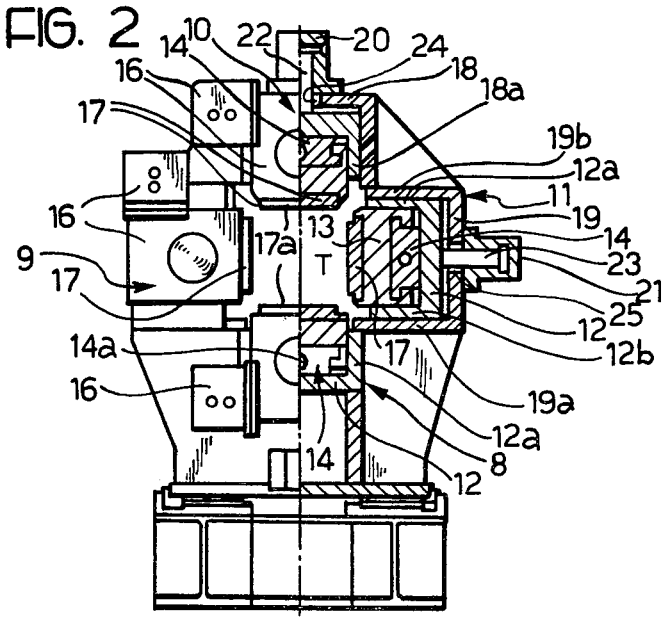
FIG. 2 is a front view, partly cut away, of the inlet guide in FIG. 1.

In the accompanying drawings, references 1 and 2 indicate two diagrammatic conventional cylinders having round grooves and forming a pair of rollers of a PPM. Reference 3 denotes a mandrel having a piercing bit 4, the mandrel extending along the rolling axis A and from the outlet side of the pair of rollers. Opposite the inlet side of the pair of rollers, the PPM bearing structure 5 defines a plane 5*a* on which a stationary rigid frame 7 is removably mounted by conventional means diagrammatically indicated at 6, the frame being adapted to hold an inlet guide for the PPM according to the invention.

The inlet guide substantially comprises four linear groups 8, 9, 10, 11 extending parallel to the rolling axis A and borne by frame 7 independently of one another, in symmetrical positions relative to axis A.

Since the linear groups 8, 9, 10, 11 are identical, we shall here for simplification give a detailed description of only one of them. In the drawings corresponding structural components of each linear group are indicated by like reference numbers.

Each linear group comprises a guide and holding means 12 extending parallel to the rolling axis A and having a substantially U-shaped cross-section open towards axis A. A linear member 13 is longitudinally positioned in holding means 12 and movably guided perpendicular to the rolling axis A by parallel rectilinear projections 12*a*, 12*b* of holding means 12.

Figure 3:
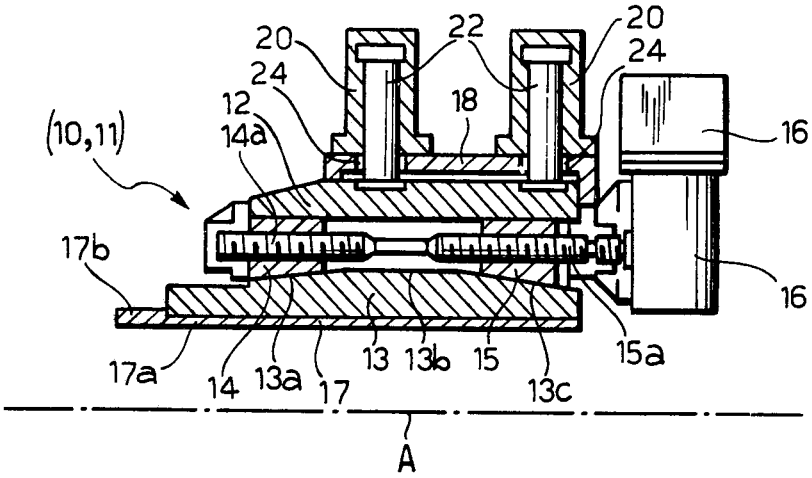
FIGS. 3 and 4 are larger-scale views in longitudinal section of two structural features of the inlet guide.
Figure 4:
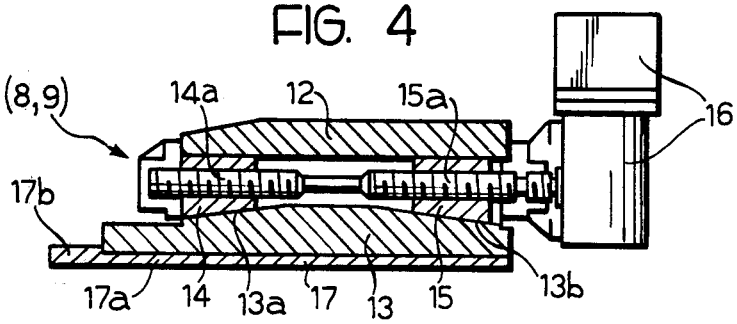

In FIGS. 3 and 4, linear member 13 has a wall facing the flat bottom of the corresponding means 12 and made up of three successive portions 13*a*, 13*b*, 13*c*, the outer portions 13*a*, 13*c* being inclined at equal and opposite angles to the rolling axis A. The inclined portions 13*a*, 13*c* co-operate with respective adjusting wedges 14, 15 disposed between linear member 13 and the flat bottom of the corresponding holding means 12. Wedges 14, 15 are actuated by respective screws 14*a*, 15*a* which are simultaneously driven by a motor and reduction gear unit bearing the general reference 16 and held by the rigid frame 7.

A rectilinear plate 17 is longitudinally secured by conventional means to the part of member 13 facing the rolling axis A. Plate 17 has a wall 17*a* facing the interior of the inlet guide according to the invention. Wall 17*a* is completely flat and parallel to axis A. Plate 17, which is made of a metal resistant to heat and wear, has an end 17*b* extending beyond the corresponding linear member 13 towards the mouth of the rolling cylinders 1, 2. Each 17*b* has a tapering shape substantially matching the shape of the aforementioned mouth (FIG. 1).

The guiding and holding means 12 of the linear groups 8, 9 are immovably held by the rigid frame 7. The plates 17 in groups 8, 9 form two walls adjacent the tunnel inlet guide according to the invention, and can be adjustably positioned with respect to rolling axis A by actuating the respective wedges 14, 15.

The guiding and holding means 12 of the remaining linear groups 10, 11 are movably mounted in box-shaped containers 18, 19 respectively, extending parallel to the rolling axis and immovably held by frame 7. Containers 18, 19 have a U-shaped cross-section open towards the rolling axis, and have parallel rectilinear projections 18*a*, 18*b*, 19*a* and 19*b* forming guides for the corresponding holding means 12 of the linear groups 10, 11 when they move perpendicular to axis A. A pair of cylinders 20, 20 and 21, 21 are secured by conventional means (not shown) to the outside of each container 18, 19 and have pistons 22, 22 and 23, 23 which slidably engage through corresponding apertures 24, 25 in the ends of containers 18, 19 and bear against the holding and guiding means 12 of the linear groups 10, 11.

The working fluid, e.g. oil, used in cylinders 20, 20 and 21, 21 is introduced at a predetermined pressure such that the corresponding linear groups 10, 11 are held in a position at which plates 17 co-operate with the corresponding plates 17 of linear groups 8, 9 to form a rectilinear tunnel having a cross-section equal to the rated cross-section of a bar (not shown) for rolling and simultaneous axial piercing in the PPM.

Cylinders 20, 20 and 21, 21 are fitted with a pressure valve (conventional and therefore not shown) for discharging the working fluid when its pressure in the cylinders increases above the charging value previously referred to.

The operation and advantages of the aforementioned inlet guide are as follows:

Initially, the rectilinear tunnel T defined by walls 17*a* of plates 17 of each linear group 8, 9, 10, 11 has a cross-section equal to that of the bars for rolling and simultaneous axial piercing. The various linear groups are positioned by suitably actuating pairs of wedges 14, 15 which act on the linear members 13. Under these conditions, the inlet guide according to the invention is adapted to hold and efficiently guide a bar until it moves between the rolling cylinders 1 and 2, the bar being accurately held along the rolling axis even when it is driven by a thrust member (not shown) against the PPM piercing bit 4. This situation ensures that the bar is accurately centred when axial piercing begins.

After the piercing begins the material buckles in the aforementioned manner at the cross-section of the bar in contact with the thrust means, with a consequent increase in the bar cross-section. In such cases, the linear groups 10, 11 are constructed to ensure continuous contact between the bar and the stationary linear groups 8, 9 thus ensuring that it remains in a given geometrical condition even when the bar cross-section varies.

Figure 5:
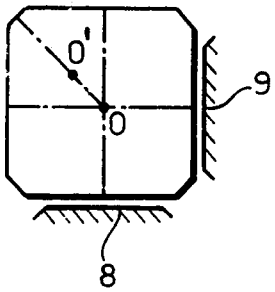
FIGS. 5 and 6 are diagrams of the inlet guide according to the invention under various operating conditions.
Figure 6:
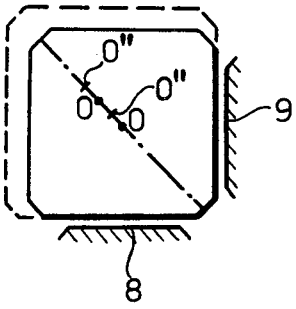

In this connection, with reference to FIGS. 5 and 6 it is known in practice that square bars leaving the furnace have two relatively cold adjacent outer walls, i.e. the wall in contact with the hearth and the front wall in the direction of advance of the bar through the furnace, which is influenced by the furnace doors. An automatic corrective effect can be obtained if the two relatively cold outer walls of the bar are made to coincide with the walls 17*a* of the stationary linear groups 8 and 9.

When the material buckles in the previously mentioned manner, the geometrical axis 0 and the thermal axis 0' of the bar (towards which the piercing bit 4 tends to move owing to the lower resistance of the material to deformation) move along the diagonal of the bar cross-section away from the stationary linear members 8 and 9. As previously stated, the piercing bit 4 tends to move towards the thermal axis 0', i.e. away from the geometrical centre along the diagonal line.

The rolling process results in further deformation of the bar, e.g. from the shape shown in continuous lines to the shape shown in broken lines in FIGS. 5 and 6.

For simplicity, we shall assume that the bar does not undergo any deformation. As a result of the aforementioned displacement of the piercing bit 4 along the thermal axis 0' during piercing there will be less material between cylinders 1, 2 and bit 4, i.e. the cylinders will exert less action on the material and guide. This will result in additional deflection of the piercing bit 4 along the diagonal, and so on.

The buckling of the bar results in a natural increase in the supply of material between the rolling cylinders and the piercing bit. As a result of the presence of the stationary linear groups 8 and 9, the buckling occurs in the direction of the hottest part of the bar (FIG. 6), resulting in greater pressure of the material against the bit. In this situation there is not a reduction but an actual increase in the supply of material between the rolling cylinders and the piercing bit in the hottest region. The excess material produces greater compression on the bit, thus counteracting its tendency to move away from the geometrical axis, as a result of nonuniform heating.

It is therefore clear that the inlet guide having the previously described structure efficiently compensates the natural tendency of the piercing bit to move towards the hottest region. Such compensation cannot be obtained by using prior art inlet guides.

In the preferred embodiment of an inlet guide according to the invention, fluidodynamic cylinders, more particularly oil actuated cylinders are used to exert the desired effect on the movable linear groups 10 and 11. However, these cylinders can be replaced by technically equivalent means, e.g. by suitably-dimensioned springs having a predetermined resilience.

We claim:

1. An inlet guide for a pressure piercing mill comprising:

a rectilinear tunnel having a square cross section and made up of four linear groups extending parallel to a rolling axis and held independently of one another by a stationary frame, each said linear group comprising a longitudinal, rigid, internal, flat rectilinear wall;

pressure means being supported by said stationary frame and operatively connected to at least two consecutive linear groups to permit selective movement of each of said consecutive linear groups in a direction perpendicular to the rolling axis when a predetermined pressure is exerted on the flat rectilinear walls of said consecutive linear groups from within said rectilinear tunnel.

2. An inlet guide according to claim 1, wherein the pressure means comprise corresponding hydraulic cylinders loaded with an operating fluid at a predetermined pressure.

3. An inlet guide according to claim 1, wherein of the four linear groups a first pair of consecutive linear groups are movable perpendicular to the rolling axis and a second pair of consecutive linear groups are secured to the stationary frame.

4. An inlet guide according to claim 1, wherein the flat inner walls of each linear group are adjustably movable perpendicular to the rolling axis to adjust the square cross section of said rectilinear tunnel to an initial transverse dimension of a square bar to be guided therethrough.

* * * * *